United States Patent [19]

Wakuda et al.

[11] Patent Number: 4,667,563

[45] Date of Patent: May 26, 1987

[54] KEY APPARATUS FOR ELECTRONIC MUSICAL INSTRUMENT

[75] Inventors: Katsumi Wakuda, Hamamatsu; Masaji Miyano, Shizuoka, both of Japan

[73] Assignee: Kabushiki Kaisha Kawai Gakki Seisakusho, Hamamatsu, Japan

[21] Appl. No.: 820,984

[22] Filed: Jan. 21, 1986

[30] Foreign Application Priority Data

Jan. 22, 1985 [JP] Japan ..... 60-6309[U]

[51] Int. Cl.[4] ..... G10C 3/12

[52] U.S. Cl. ..... 84/439; 84/433

[58] Field of Search ..... 84/433, 439, 440

[56] References Cited

U.S. PATENT DOCUMENTS

| | | | |
|---|---|---|---|
| 2,848,920 | 8/1958 | Lester | 84/433 X |
| 4,217,803 | 1/1979 | Dodds . | |
| 4,375,179 | 3/1983 | Schwartz et al. | 84/439 |
| 4,479,415 | 10/1984 | Haberstumpf | 84/439 |

FOREIGN PATENT DOCUMENTS

| | | | |
|---|---|---|---|
| 29-41708 | 3/1954 | Japan . | |
| 30-133482 | 11/1955 | Japan . | |
| 19728 | 2/1979 | Japan | 84/433 |

*Primary Examiner*—Lawrence R. Franklin
*Attorney, Agent, or Firm*—Michael N. Meller

[57] ABSTRACT

A key apparatus is provided in which the resistance of the keys to being depressed is such that the touch feeling of a real piano key is simulated. A key is pivotally mounted so that rotation is performed in response to depression. A weighted lever and a weight embedded in the key serve to urge the key in the opposite rotational direction. A deformable element is arranged so that it contacts the key after the key has been depressed a predetermined distance. The resistance of the deformable element to being deformed initially increases as the key is depressed beyond the predetermined distance, and then decreases as the key is depressed further.

8 Claims, 11 Drawing Figures

KEY APPARATUS FOR ELECTRONIC MUSICAL INSTRUMENT

FIELD OF THE INVENTION

This invention relates to a key apparatus for an electronic musical instrument such as an electronic piano.

BACKGROUND OF THE INVENTION

In known electronic musical instruments such as electronic pianos, it has hitherto been customary practice to provide a key arrangement like that shown in FIG. 1. As can be seen in FIG. 1, a key a is supported at a supporting point c of a frame b such that the key can rotate about an axis passing through the supporting point c perpendicular to the plane of the drawing. A tension spring d is resiliently coupled to the base end portion of the key for providing a force for restoring the key to its undepressed position.

This conventional key arrangement has the disadvantage that the relationship of the depression force to the stroke or displacement of the key a has the characteristic curve shown in FIG. 2. As a result of this relationship the player can only experience the touch feeling produced by the gradual and monotonous increase of the force required to depress the key from the beginning to the end of a depression stroke. The player is unable to experience a touch feeling like that produced by an actual piano key during depression.

SUMMARY OF THE INVENTION

The object of the invention is to eliminate this deficiency in the conventional electronic musical instrument by providing a key apparatus which can give the player a key touch feeling similar to that experienced during the playing of an actual piano.

This object is achieved in accordance with the invention by providing a key apparatus in which a weight is embedded in the base end portion of each key, a lever applies a force which restores the key to its undepressed position by way of an adjusting screw seated on the base end portion of the key, and a bowl-shaped element made of resilient material is arranged such that it comes into contact with the key when the key is depressed a predetermined distance and is deformed by the key as the key is further depressed beyond that predetermined distance.

BRIEF DESCRIPTION OF THE DRAWINGS

The preferred embodiments of the invention will be described in detail with reference to the drawings, wherein.

DETAILED DESCRIPTION OF THE PREFERRED EMBODIMENTS

Figure 3:
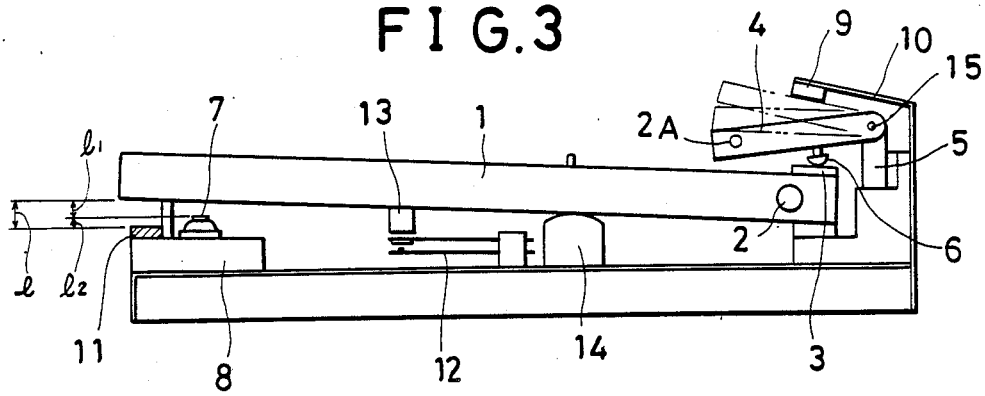
FIG. 3 is a side view of a preferred embodiment of the invention.

A preferred embodiment of the invention is shown in FIG. 3. The key 1 is pivotably supported at a supporting point 14 such that the key can rotate in either direction about an axis passing through point 14 perpendicular to the plane of the drawing. A weight 2 is embedded in the base end portion of key 1 and a bushing cloth 3 (made of leather sheet or the like) is adhered to an upper surface of the base end portion. The lever 4 is pivotably supported at one end by a pivot pin 15, which is in turn seated in the lever flange 5. The other end of the lever 4 has a weight 2A embedded therein. The lever 4 exerts a force on the bushing cloth 4 of the base end portion by way of an adjusting screw 6 such that the key is urged in a rotational direction opposite to the direction in which the key rotates during depression. This force restores the key to its undepressed position when the depression force is removed. The bowl-shaped element 7, in the embodiment of FIG. 3, is mounted on a front pin frame 8 connected to the main body of the musical instrument. This bowl-shaped element is made of a resilient, i.e. elastic, material such as rubber. A felt stopper 9 affixed to the lever stopper 10 serves to stop the lever 4 and key stopper 11 serves to stop the key 1. The key switch 12 is arranged to be closed by an actuator 13 coupled to the key.

Figure 4A:
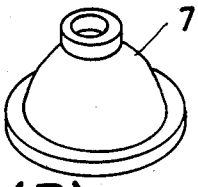
FIGS. 4A and 4B are a perspective view and a sectional view of a bowl-shaped element incorporated in the preferred embodiments.
Figure 4B:
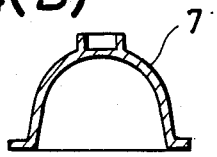

The bowl-shaped element 7 is shown in greater detail in FIGS. 4A and 4B. The height of the bowl-shaped element 7 is such that its tip comes into contact with the key when the latter has been depressed by the distance $l_1 = \frac{2}{3}\, l$, where $l$ represents the full stroke of the key.

Figure 1:
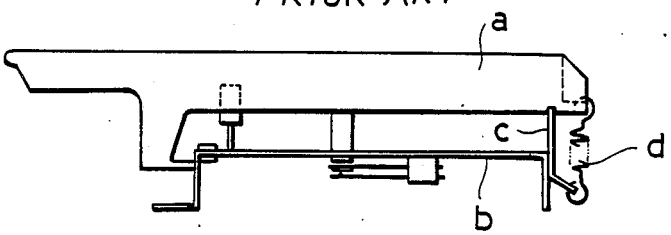
FIG.1 PRIOR ART
FIG. 1 is a side view of a conventional key apparatus.
Figure 2:
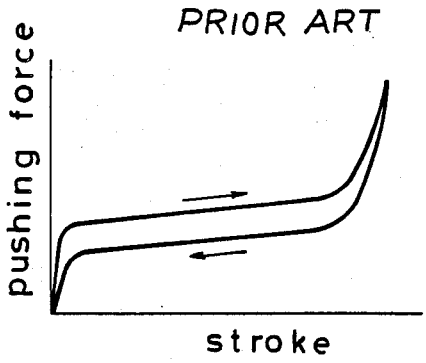
FIG.2 PRIOR ART
FIG. 2 is a diagram showing the relationship between the depression force and the stroke of the key in the conventional key apparatus of FIG. 1.
Figure 5:
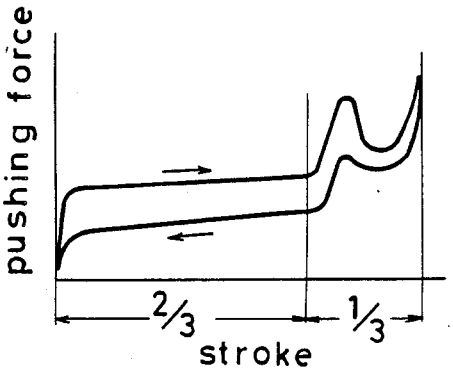
FIG. 5 is a diagram showing the relationship between the stroke of the key and the depression force for the key shown in FIG. 3.
Figure 6A:
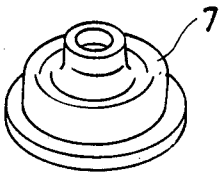
FIGS. 6A and 6B are a perspective view and a sectional view of the bowl-shaped member in the deformed condition.
Figure 6B:
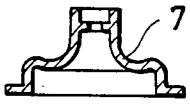

The preferred embodiment shown in FIG. 3 is operated as follows. When the end of the key opposite the base end portion is depressed, key 1 rotates about the supporting point 14. As the key is rotated from the undepressed position to the position where the key is depressed by the distance $l_1 = \frac{2}{3}\, l$, the combined weight of weight 2 embedded in the key and weight 2A embedded in the lever exert a constant force in opposition to the depression force. Therefore, the finger of the player experiences a substantially constant pressure equal and opposite to the substantially constant depression force being applied as the key stroke increases from 0 to $l_1$. This substantially constant depression force is shown in relation to the magnitude of the depression of the key in FIG. 5. At this juncture (i.e. when the magnitude of the stroke equals $l_1$) the key 1 comes into contact with the bowl-shaped element 7. If the key is further depressed beyond this point of contact, then the bowl-shaped element becomes increasingly deformed until it attains the collapsed state, shown in FIGS. 6A and 6B, when the magnitude of the stroke equals $l$ (i.e. the full stroke length). During the course of the key depression from the position corresponding to a stroke of length $l_1$ to the position corresponding to a stroke of length $l$, as shown in FIG. 5, the depression force required is increased by a factor of about 1.5 as compared to the constant depression force applied during the movement of the key from the undepressed position to the position corresponding to a stroke of length $l_1$. Thereafter, the depression force required is decreased to a value equal to 50–70% of the increased depression force. This change in depression force produces a clicking sensation which is transmitted to the player's finger. This clicking sensation is similar to the touch feeling which a piano player experiences when during depression of a piano key, the jack of an action mechanism separates from a bat or hammer shank roller which the jack has pushed upward. If the key 1 of the invention is further depressed, its lower surface will abut the key stopper element 11, thereby completing the depression operation.

When the key is released by the player, it is restored to its undepressed position under the influence of the gravitational forces exerted by the weights 2 and 2A.

Figure 7:
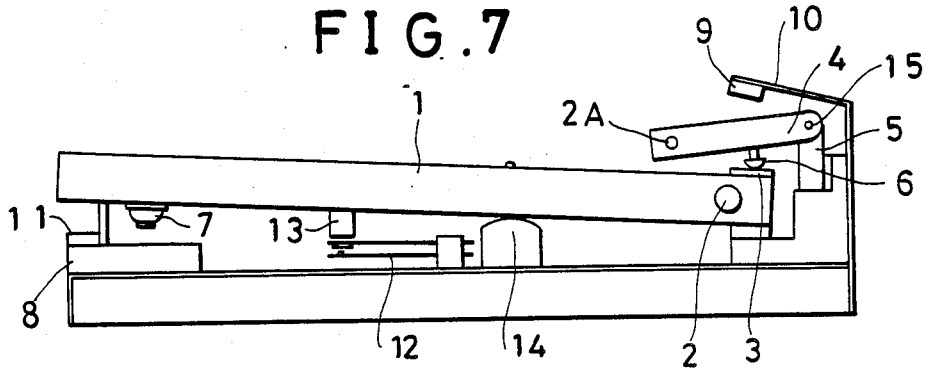
FIG. 7 is a side view of another preferred embodiment of the invention.
Figure 8:
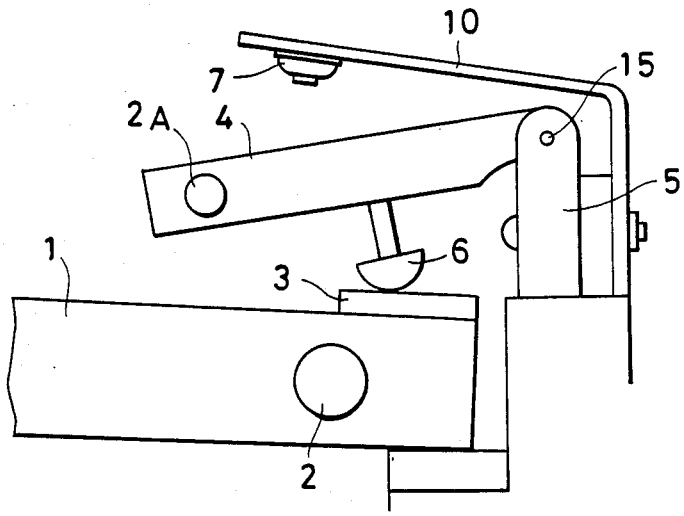
FIG. 8 is a side view of a portion of a third preferred embodiment.
Figure 9:
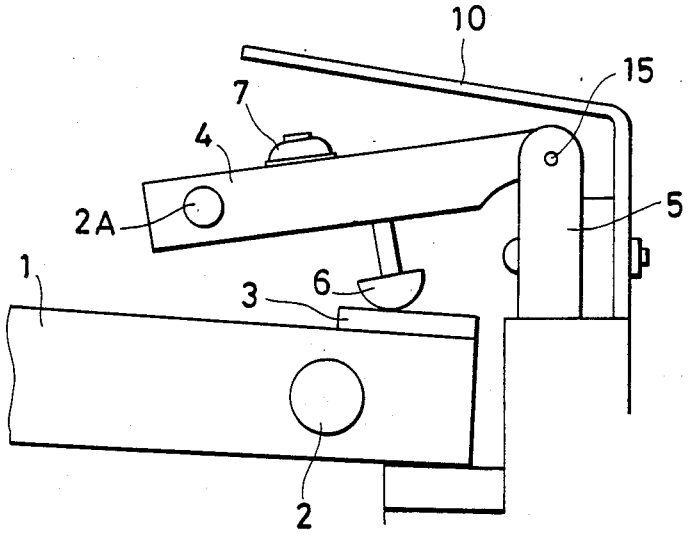
FIG. 9 is a side view of a portion of a fourth preferred embodiment.

In the above-described preferred embodiment, the bowl-shaped element 7 was mounted on the front pin frame 8. However, this element may be attached to a lower surface of the key 1 as shown in FIG. 7 with equal effect. Alternatively, the bowl-shaped element 7 may be provided on a lower surface of the lever stopper element 10, as shown in FIG. 8, or on an upper surface of the lever 4, as shown in FIG. 9. In all of these embodiments the resulting touch feeling has the characteristic curve shown in FIG. 5.

When, in conjunction with the depression of key 1, the lever 4 is pushed upward by the base end portion of the key, a forward end of the adjusting screw 6 and the bushing cloth 3 are brought into frictional contact with each other, so that the generation of noise can be prevented and a suitable frictional force can be obtained.

The foregoing description of the preferred embodiment is presented for illustrative purposes only and is not intended to limit the scope of the invention as defined in the appended claims. Modifications may be readily effected by one having ordinary skill in the art without departing from the spirit and scope of the inventive concept herein disclosed.

What is claimed is:

1. In a key apparatus for an electronic musical instrument such as an electronic piano, consisting of a key which is pivotably supported by a first support means for rotation about an axis, and urging means for applying a force on one end of said key for urging said key to rotate in a direction opposite to the direction in which said key rotates during a depression operation, wherein said key is provided with a weight in the vicinity of said one end, said urging means comprises a lever mechanically coupled to said key by way of an adjusting screw and a deformable means made of resilient material is arranged to contact said key when said key has been depressed a predetermined distance and is deformed by said key when said key is depressed beyond said predetermined distance, the improvement wherein said deformable means comprises a collapsible bowl-shaped element.

2. The key apparatus of claim 1, wherein a weight is provided in said lever, said lever being pivotably supported by a second support means.

3. The key apparatus of claim 1, wherein said deformable means has a height such that said key initially contacts said deformable means when said key is depressed a distance equal to approximately two-thirds of the maximum distance by which said key can be displaced by depression.

4. The key apparatus of claim 1, wherein the resistance of said deformable means to being deformed initially increases as said key is depressed beyond said predetermined distance and then decreases as said key is further depressed.

5. The key apparatus of claim 1, wherein said deformable means is provided on a front pin frame of a main body of the musical instrument.

6. The key apparatus of claim 1, wherein said deformable means is provided on a lower surface of said key.

7. The key apparatus of claim 1, wherein said deformable means is provided on an upper surface of said lever.

8. The key apparatus of claim 1, wherein said deformable means is provided on a lower surface of a lever stopper which is arranged to stop said lever.

* * * * *